US005526292A

United States Patent [19]

Hodgson et al.

[11] Patent Number: 5,526,292

[45] Date of Patent: Jun. 11, 1996

[54] BROADBAND NOISE AND VIBRATION REDUCTION

[75] Inventors: Douglas A. Hodgson, Fuguay-Varina; Mark R. Jolly, Holly Springs; Mark A. Norris; Dino J. Rossetti, both of Raleigh; Douglas A. Swanson, Apex; Steve C. Southward, Cary, all of N.C.

[73] Assignee: Lord Corporation, Erie, Pa.

[21] Appl. No.: 347,523

[22] Filed: Nov. 30, 1994

[51] Int. Cl.[6] ..... G10K 11/16

[52] U.S. Cl. ..... 364/574; 244/1 N; 381/71

[58] Field of Search ..... 73/35; 381/71; 364/506, 439, 574; 267/140.11; 244/17.27, 1 N, 54

[56] References Cited

U.S. PATENT DOCUMENTS

| | | | |
|---|---|---|---|
| 3,936,606 | 2/1976 | Wanke | 179/1 P |
| 4,044,203 | 8/1977 | Swinbanks | 179/1 P |
| 4,111,035 | 9/1978 | West et al. | 73/35 |
| 4,506,380 | 3/1985 | Matsui | 381/71 |
| 4,669,122 | 5/1987 | Swinbanks | 381/71 |
| 4,689,821 | 8/1987 | Sulikuddin et al. | 381/71 |
| 4,715,559 | 12/1987 | Fuller | 244/1 N |
| 4,795,123 | 1/1989 | Forward et al. | 248/550 |
| 4,815,139 | 3/1989 | Eriksson et al. | 381/71 |
| 4,819,182 | 4/1989 | King et al. | 364/508 |
| 4,837,834 | 6/1989 | Allie | 381/71 |
| 5,010,576 | 4/1991 | Hill | 381/71 |
| 5,060,271 | 10/1991 | Geddes | 381/71 |
| 5,111,507 | 5/1992 | Nakaji | 381/71 |
| 5,131,047 | 7/1992 | Hashimoto et al. | 381/71 |
| 5,133,017 | 7/1992 | Cain et al. | 381/71 |
| 5,146,505 | 9/1992 | Pfaff et al. | 381/71 |
| 5,170,433 | 12/1992 | Elliott et al. | 381/47 |
| 5,174,552 | 12/1992 | Hodgson et al. | 267/140.11 |
| 5,195,046 | 5/1993 | Gerardi et al. | 364/506 |
| 5,216,722 | 6/1993 | Popovich | 381/71 |
| 5,224,168 | 6/1993 | Martinez et al. | 381/71 |
| 5,229,556 | 7/1993 | Geddes | 181/206 |
| 5,245,552 | 9/1993 | Anderson et al. | 364/508 |
| 5,245,664 | 9/1993 | Kinoshite et al. | 381/71 |
| 5,251,262 | 10/1993 | Suzuki et al. | 381/71 |
| 5,267,320 | 11/1993 | Fukumizu | 381/71 |
| 5,267,321 | 11/1993 | Langberg | 381/72 |
| 5,272,286 | 12/1993 | Cain et al. | 181/206 |
| 5,278,913 | 1/1994 | Delfosse et al. | 381/71 |
| 5,310,137 | 5/1994 | Yoerkie, Jr. et al. | 244/17.27 |
| 5,315,661 | 5/1994 | Gossman et al. | 381/71 |
| 5,316,240 | 5/1994 | Girard et al. | 244/17.27 |
| 5,361,303 | 11/1994 | Eatwell | 381/71 |
| 5,410,607 | 4/1995 | Mason et al. | 381/71 |
| 5,418,858 | 5/1995 | Shoureshi | 381/71 |

*Primary Examiner*—Kevin J. Teska
*Assistant Examiner*—Russell W. Frejd
*Attorney, Agent, or Firm*—Richard K. Thomson; Randall S. Wayland; James W. Wright

[57] ABSTRACT

An active noise and vibration cancellation system with broadband control capability. A broadband disturbance signal detector positioned within a closed compartment such as an aircraft cabin or vehicle passenger compartment provides a signal representative of the frequency spectrum and corresponding relative magnitude of a broadband signal emanating from a vibrational energy source to a controller. The controller receives the broadband disturbance signal as well as error signals from error sensors which, by virtue of adaptive filters within the controller, enhance the cancellation capability of the control signals produced by one or more actuators positioned within the compartment.

14 Claims, 11 Drawing Sheets

BROADBAND NOISE AND VIBRATION REDUCTION

BACKGROUND AND SUMMARY OF THE INVENTION

The present invention is directed to an active noise and vibration control (ANVC) system. More particularly, the present invention relates to certain improvements in ANVC systems permitting enhancement of control over a range of frequencies including broadband control and optimization of total energy within the system. The present application is related to application Ser. No. 08/347,521, filed Nov. 30, 1994 entitled "Frequency-Focused Actuators for Active Vibration Energy Control Systems".

Various active noise control (ANC) systems have been proposed which generate an inverted-phase signal of comparable frequency and magnitude to the input, or disturbance, signal which combines destructively with the disturbance signal to eliminate or, at least, significantly reduce the noise within a control volume such as, for example, the interior of an aircraft cabin. A broadband actuator, typically a speaker, has to be of significant size to produce the low-frequency vibrations (20–100 Hz) needed for destructive interference making their placement within the cabin problematic. The problem is aggravated by the fact that in order to control the high-frequency vibrations in the range of 100–500 Hz, there needs to be a large number of speakers because of the increased number of modes. Normally, for higher frequencies the control efficiency tends to be localized within one-tenth of a wavelength from the closest error sensor (which is generally a microphone). The placement of actuators is more critical for high-frequency vibrations.

Similar problems arise in active vibration control (AVC) systems with actuators having to be sized to accommodate the low-frequency (typically, high amplitude) vibrations while the number utilized must be determined by the highest frequency for which control is desired. In addition, systems like Fuller (U.S. Pat. No. 4,715,559) which solely employ actuators to control sound energy to cancel tonal noise can actually input large amounts of vibrational energy into the system to accomplish optimum sound reduction at the error microphones. This increased vibrational energy put into the system can have a negative impact on the fatigue life of the structure. Further, optimum passenger comfort is actually arrived at by a compromise solution resulting in a less-than-optimum noise control in favor of avoiding excessive structural vibration.

The present invention solves the problems of the prior art ANVC devices by subdividing the control responsibility of the low (20–100 Hz, for example) frequency from the high-frequency (100–500 Hz) actuators by frequency focusing the respective actuator groups, permitting the physical size, the force capability, and the number of actuators in the respective groups to be optimized for the application. The term "actuator" when used herein shall include both speakers and structural actuators such as inertial shakers and piezoelectric actuators unless otherwise specified. Further, although the term "high-frequency" is used here to contrast it from the low-frequency band described herein, the range of 100–500 Hz is normally regarded as midrange. Finally, the term "vibrational energy" when used herein shall refer to both structural vibrational and audible or sound vibrational energy.

Another aspect of the present invention is a hybrid speaker and structural actuator system which employs these actuators to maximize the respective advantages of each.

Elliott et al. (U.S. Pat. No. 5,170,433) infers a system which uses a combination of equal numbers of speakers and inertial actuators to cancel one or more harmonics of a tonal noise signal (FIG. 10). The present invention uses structural actuators to control noise in the low-frequency range (≦70 Hz) where the interior noise is directly coupled to the structural vibration. Either microphones or accelerometers could serve as error sensors for the low-frequency actuators. In the high-frequency range where the interior noise is not directly coupled to structural vibration, it is preferred to use speakers to control noise so as not to increase the structural vibrational energy in the compartment while quieting the noise. Microphones should be used as error sensors in the high-frequency range. While microphones may be shared as error sensors for both low- and high-frequency actuators, the accelerometers should be frequency focused for use by only the structural actuators.

It is well known that the number of actuators required for a particular ANVC system is equal to the number of vibrational energy modes participating in the system response. If a particular cabin is, through experimentation, shown to have K vibrational energy modes, then the number of low-frequency actuators M needed to achieve global noise reduction is given by the expression $M \geqq K$. For high-frequency control, where the number of vibrational energy modes is greater, it is generally impractical to achieve global control due to the large number of actuators needed. For local control, which produces optimum control efficiency within one-tenth of a wavelength of the error sensor, the number of actuators N needed is related to the number of sensors L by the expression $N \geqq L/2$; that is, the number of actuators must be equal to or greater than one half the number of error sensors employed in the system to produce the desired reduction of sound at each of the error sensors.

The majority of ANC and ANVC systems have tonal-control capability only, that is, they are not able to handle multiple tones and/or background noise. The present invention includes, as one aspect thereof, an ANVC system employing a broadband reference-signal-detecting means producing an output signal indicative of the broadband noise and vibration to be canceled within the cabin, error sensor means for detecting a residual level of vibrational energy within the cabin downstream of said reference signal means, actuator means capable of generating a phase-inverted signal to reduce at least some portions of the broadband vibrational energy within said compartment, and a broadband controller which includes a plurality of adaptive filters for generating broadband, time-domain command signals which activate said actuators to produce the desired control signal(s).

Various other features, advantages and characteristics of the present invention will become apparent after a reading of the following detailed description thereof.

BRIEF DESCRIPTION OF THE DRAWINGS

The figures set forth the preferred embodiments in which like reference numerals depict like parts.

DETAILED DESCRIPTION OF THE PREFERRED EMBODIMENTS

Figure 1:
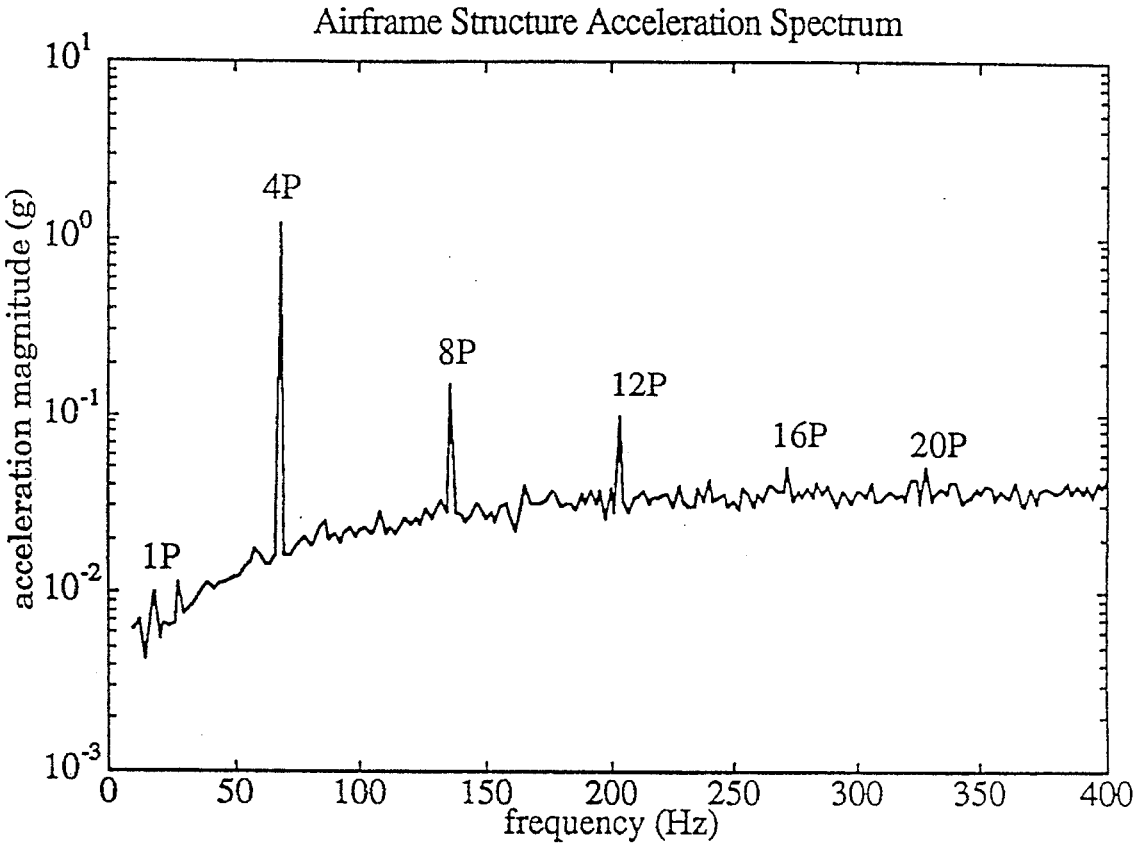
FIG. 1 is an acceleration vs. frequency plot for a typical turboprop airframe.

One of the features of the present invention is frequency-focused actuation, that is, that individual actuators can be designed to operate predominantly in a specific frequency range, the presumption being that multiple ranges are beneficial. For example, in a turboprop aircraft application, different actuators could be used to control interior noise and structural vibration at the 4P, 8P, 12P, etc., blade passage frequencies. If P is the rate of rotation of the drive shaft of an engine in revolutions per second, then 4 P will be the passage frequency of a four-bladed prop, 8 P the first harmonic, 12 P the second harmonic, etc. Typically, for turboprop applications, the blade pass frequency and its harmonics tend to be the principal contributors to the cabin vibration, and its resultant interior noise, as shown in FIG. 1.

The principle involved in frequency-focused actuators is that for a particular enclosure, a small number of actuators are needed to globally control vibrational energy at low frequencies because both acoustic and structural modal density is relatively small. At high frequencies, a larger number of actuators is needed to control both noise and vibrational energy because modal density increases. Because the force requirements are generally different for the different frequency ranges, because the placement of large actuators is difficult, and because the placement of the high-frequency actuators is critical, it makes sense to subdivide the low- and high-frequency actuators to attack these different frequency ranges of an input signal having different spectral frequencies.

For applications where use of speakers is appropriate, a first group of low-frequency speakers or sub-woofers is used. The number M in this group will ordinarily be equal to or greater than the number K of dominant low-frequency modes within the passenger compartment; that is, $M \geqq K$. The number of speakers in the group of midrange or higher-frequency speakers will typically need to be greater since modal density is higher and control is localized around the error microphones. It is preferred that the number N of high-frequency speakers be equal to or greater than one-half the number of error microphones L; that is $N \geqq L/2$. By subdividing the low and high-frequency responsibilities, the low-frequency speakers can be adequately sized to perform their function and the high-frequency speakers can be adequately numbered and positioned to more efficiently perform their function. The frequency-focusing concept allows the configuration of the cabin and what we know about its acoustic behavior to be used advantageously to enhance performance of the ANVC system.

Figure 2:
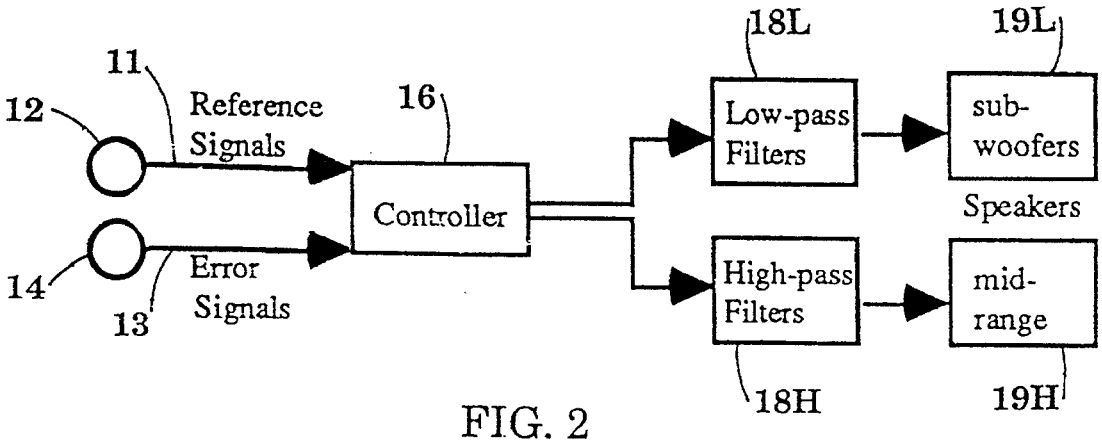
FIG. 2 is block diagram of a first control system to implement frequency focusing.

Frequency focusing can be implemented in at least four ways. A first way is depicted in FIG. 2 where reference signals 11 are fed from a reference sensors 12 and error signals 13 are fed from sensors 14 through controller 16 to filters 18L and 18H which exclude frequencies outside the particular band so the signal which is fed to the respective low frequency speaker 19L or high-frequency speaker 19H (identified here as midrange) is in the desired range. When this system is initialized, system ID will result in each of the band-pass filters being assigned a very small transfer function for frequencies outside the respective filter's band. This, in essence, imposes a cross-over frequency on the system.

Figure 3:
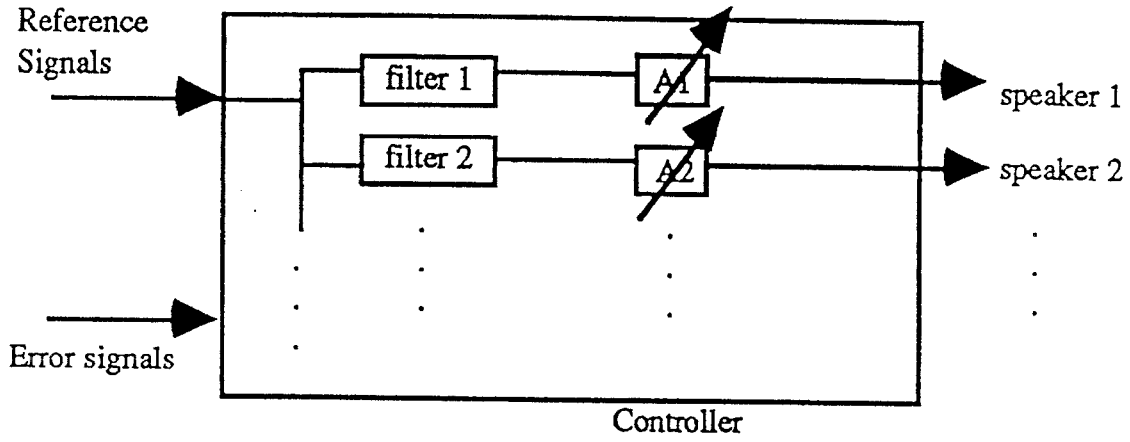
FIG. 3 is a block diagram of a second control system for implementing frequency focusing.

A second way to frequency-band focus the speakers is depicted in FIG. 3. In this embodiment, band-pass filters 18L' and 18H' are internalized within the controller and the reference signals 11' are subdivided for the respective speakers 19L' and 19H' and these reference signals are filtered after being split.

Yet a third way for frequency-band focusing the speakers is to utilize separate controllers in parallel, one controlling the low-frequency speakers and one controlling the high-frequency speakers. The controllers may use dedicated or shared error sensors.

Figure 4A:
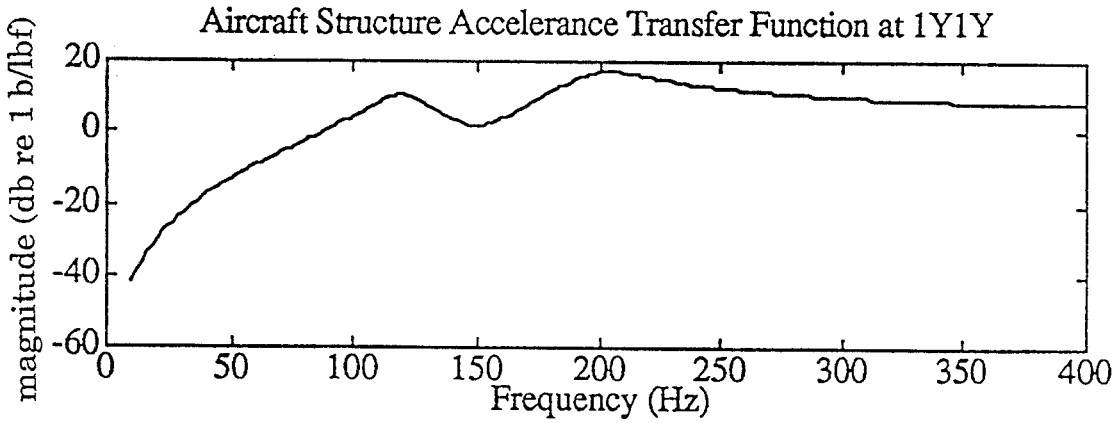
FIG. 4*a* is magnitude vs. frequency plot for an aircraft structure accelerance transfer function at 1YIY.
Figure 4B:
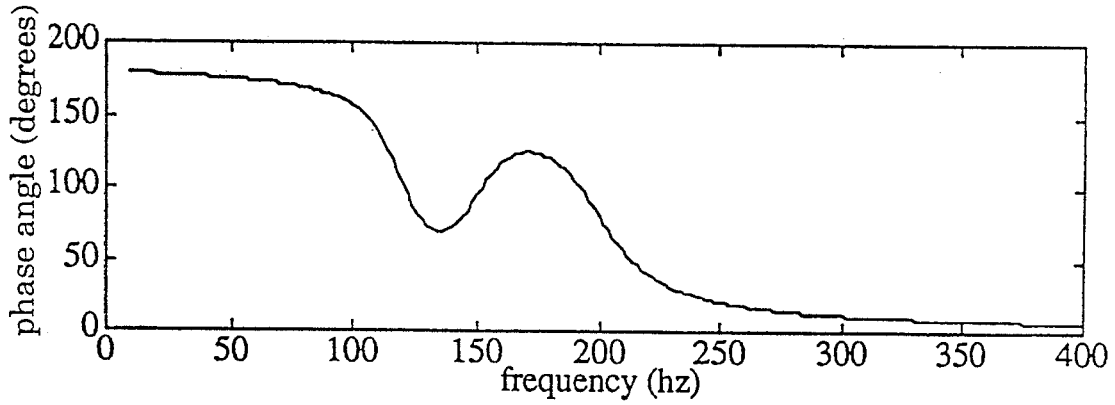
FIG. 4*b* is the phase angle vs. frequency plot of the transfer function shown in FIG. 4*a;*
Figure 5:
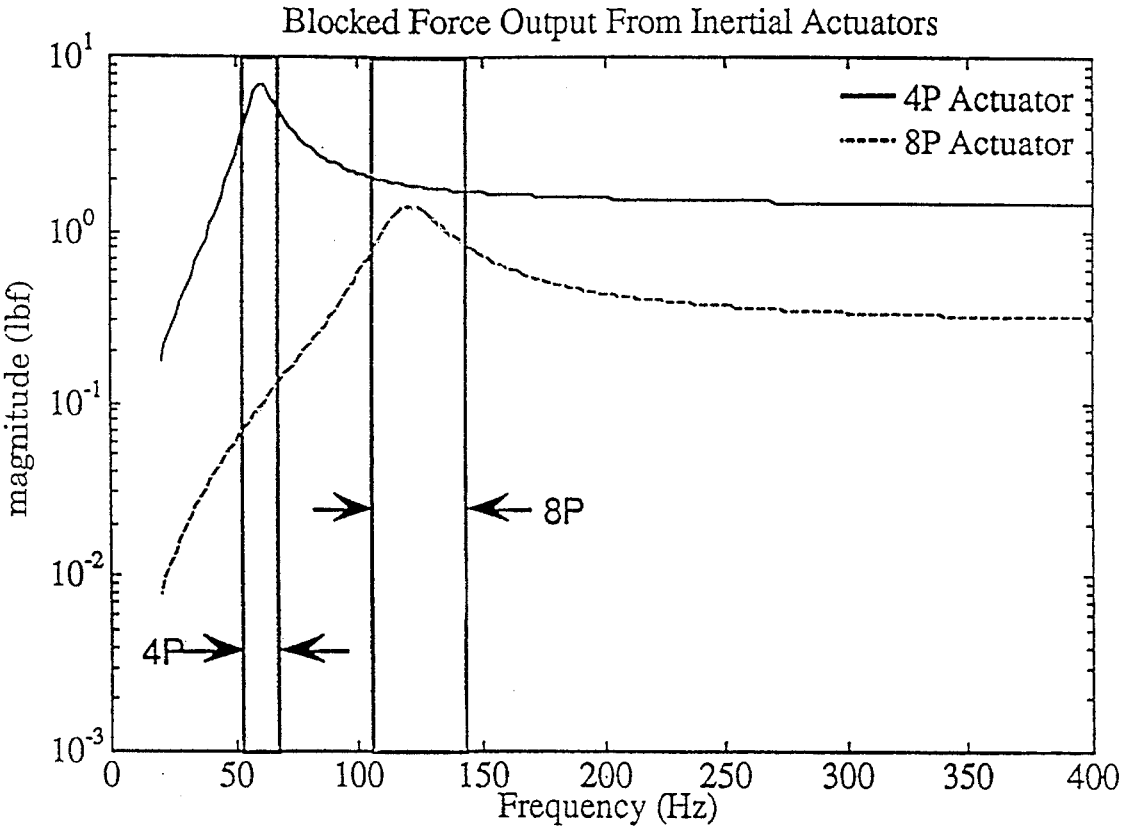
FIG. 5 is a magnitude vs. frequency plot for typical force output from inertial actuators.

Similar techniques can be used in frequency focusing structural actuators, as well. FIG. 4*a* shows the magnitude of the structural accelerance transfer function of a typical turboprop fuselage. FIG. 4*b* shows a typical phase angle vs frequency plot for the same structure. From the plot shown in FIG. 1 (which is taken from the same turboprop fuselage) and the plots of FIGS. 4*a* and 4*b*, it can be demonstrated that an inertial actuator capable of controlling the 4 P peak would need to have a force output of five pounds while the force needed to handle the 8 P peak would need only be sized to produce 0.2 pounds. The efficiencies gained from subdividing the cancellation functions of the 4 P and 8 P tones will be readily apparent. The inertial actuators in each case should be tuned for the lower end of their respective frequency ranges in order to provide adequate control force. The weight reduction for required actuators is also significant. The blocked force required for each of the inertial actuators is shown in FIG. 5.

Figure 6:
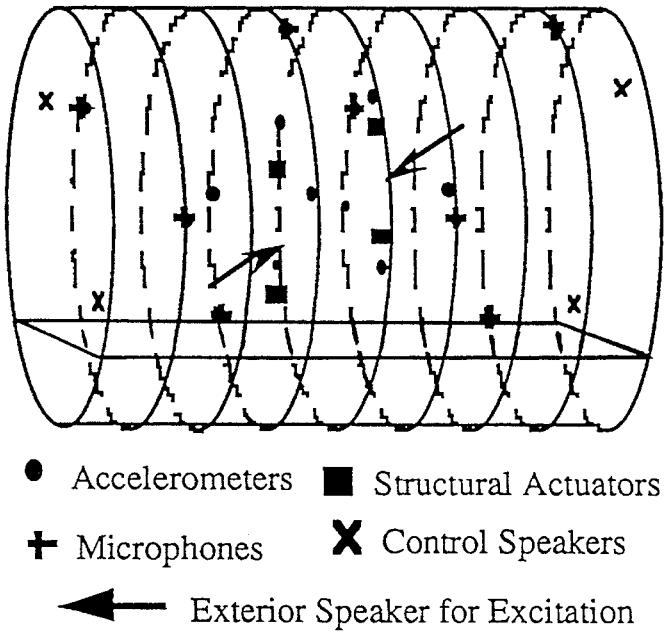
FIG. 6 is a schematic representation depicting the relative locations of accelerometers, actuators, microphones and control speakers within an aircraft cabin.

A series of tests were conducted using an existing aircraft cabin or fuselage 20 as seen in FIG. 6. The interior of cabin 20 was equipped with a series of speakers 22 and structural actuators 24 as counter-vibration producing elements and accelerometers 26 and sixteen microphones 28 as feedback or error signal sensors. Two external speakers were mounted on the exterior of the fuselage at A and B to simulate engine noise impinging on the cabin 20. Recorded engine noise was fed to the external speakers and the various ANVC elements employed to reduce the internal cabin noise.

Figure 7A:
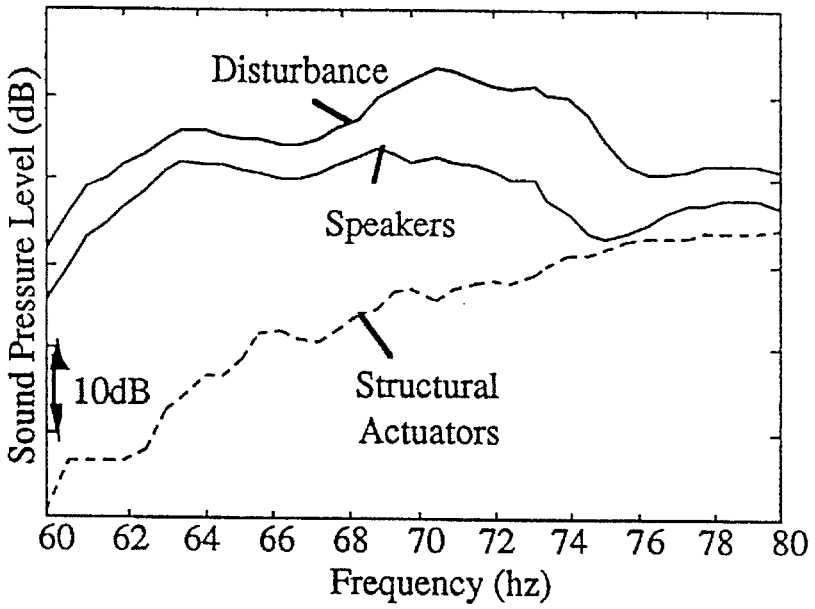
FIG. 7*a* is a plot of sound pressure vs. frequency in the low-frequency range for the control system depicted in FIG. 6.

FIG. 7*a* illustrates the average sound pressure level inside the fuselage over the 4 P frequency range for both structural based actuators and speakers. Microphones were used as the error sensors. It is noteworthy that the structural based actuators achieve greater noise reductions below about 75 Hz.

Figure 7B:
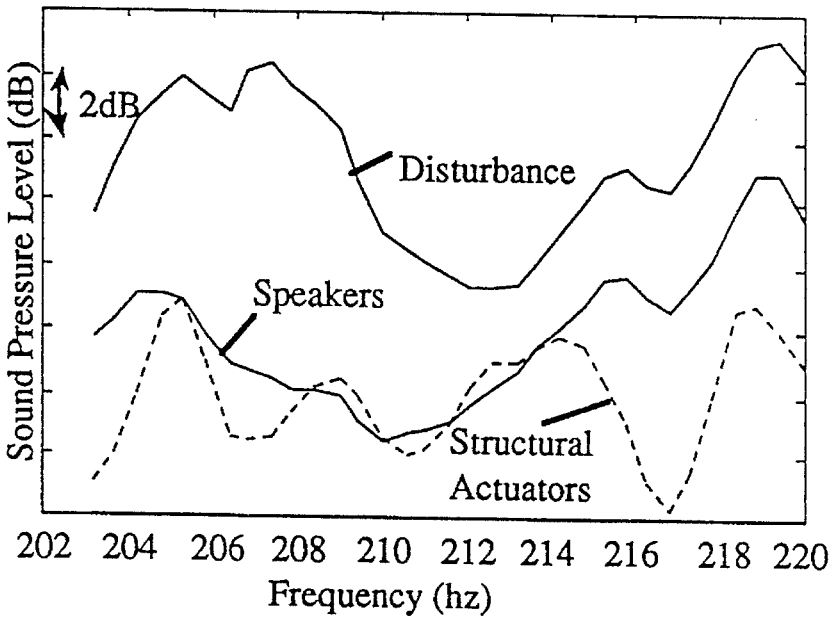
FIG. 7*b* is a plot of sound pressure vs. frequency in the higher-frequency range for the control system depicted in FIG. 6.

FIG. 7*b* illustrates the average sound pressure level inside the fuselage over the 12 P frequency range for both structural based actuators and speakers. Again, microphones were used as the error sensors.

FIGS. 7*a* and 7*b* demonstrate that structural based actuators can achieve greater noise reductions than speakers over the 4 P frequency range. They also show that the noise reductions achieved using structural based actuators and speakers are comparable over the 12 P frequency range. If noise alone were the criteria for choosing actuators, then structural based actuators would probably be used to reduce interior noise at the 4 P frequency range and structural based actuators or speakers could be used to reduce noise over the 12 P frequency range.

Figure 8A:
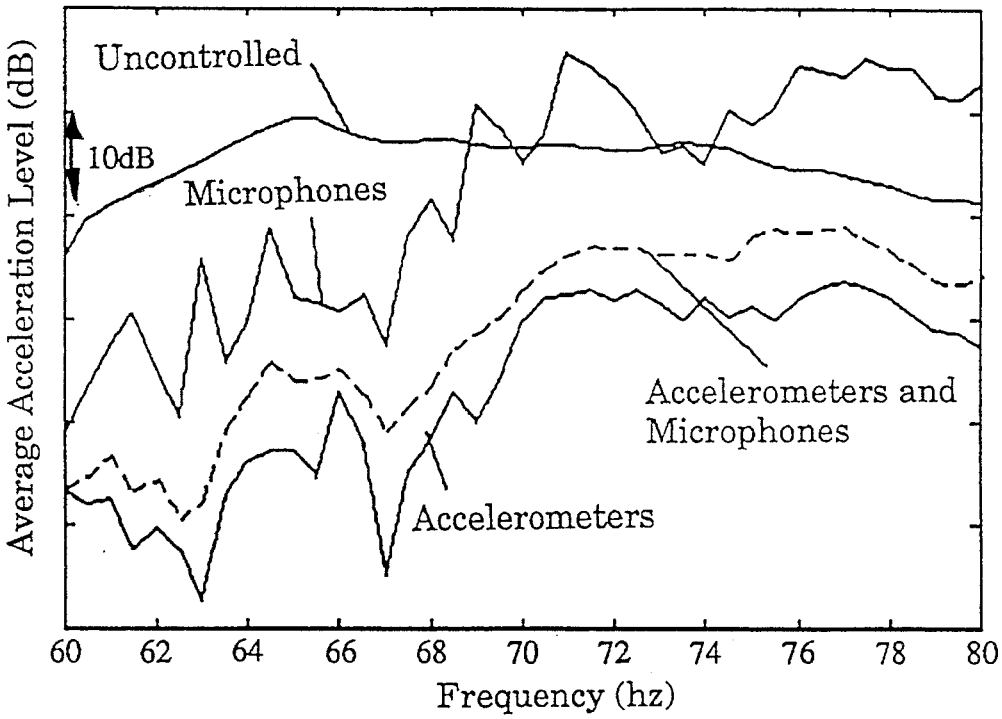
FIG. 8*a* is a plot of average acceleration vs. frequency using structural based actuators with various control sensors over the 4 P range.

FIG. 8*a* shows the average fuselage acceleration over the 4 P frequency range for structural based actuators using accelerometers, microphones, and combinations thereof. Note that because speakers do not affect structural vibration, the uncontrolled vibration level shown in FIG. 8*a* is equivalent to the controlled vibration level when speakers and microphones are used. FIG. 8*a* illustrates that structural based actuators can achieve significant vibration reductions. Below 70 Hz, either microphones or accelerometers could be used as the error sensors. Above 70 Hz, however, a combination of accelerometers and microphones should be used to ensure that both vibration and noise is reduced. In the 4 P frequency range, the structural based actuator control system significantly outperforms a speaker based control system.

Figure 8B:
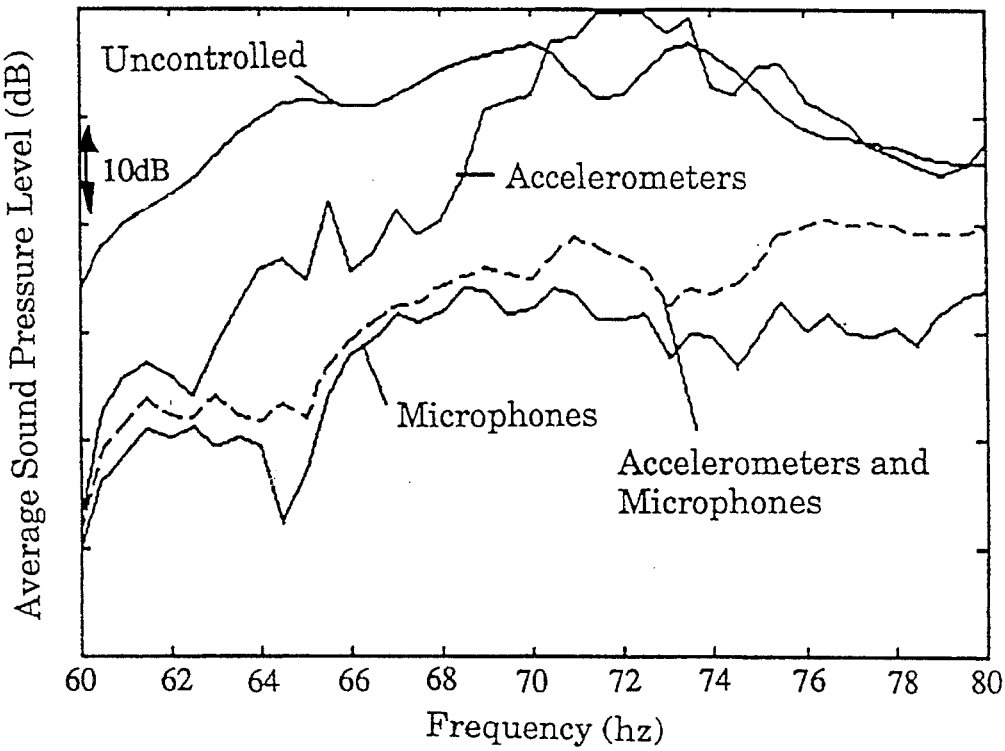
FIG. 8*b* is a plot of average sound pressure level vs. frequency using structural based actuators with various control sensors over the 4 P range.

FIG. 8*b* shows the average sound pressure level over the 4 P frequency range for structural based actuators using accelerometers, microphones, and combinations thereof. It can be seen that a control system with structural based actuators and microphones and accelerometers as error sensors provided excellent reductions in both sound pressure level and structural vibration. Over the 4 P frequency range, the structural vibration is directly coupled to the acoustics, resulting in significant vibration and noise reductions. Over this frequency range, structural based actuators should be used with microphones and/or accelerometers.

Figure 9A:
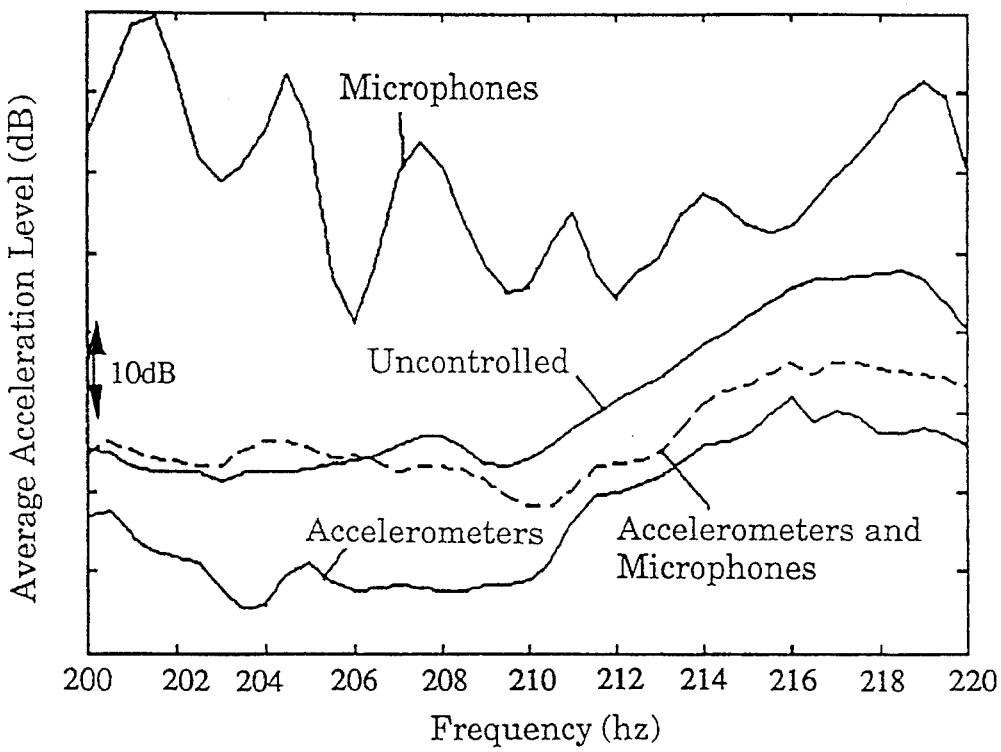
FIG. 9*a* is a plot of average acceleration vs. frequency using structural based actuators with various control sensors over the 12 P range.
Figure 9B:
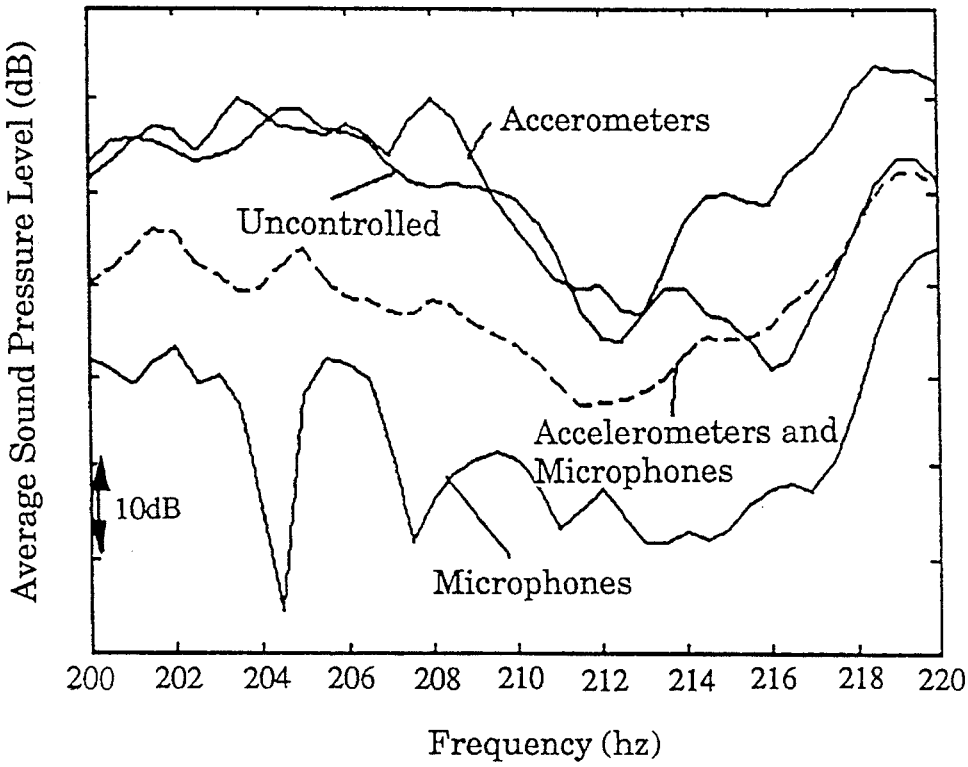
FIG. 9*b* is a plot of average sound pressure level vs. frequency using structural based actuators with various control sensors over the 12 P range.

FIGS. 9*a* and 9*b* illustrate the average fuselage acceleration and sound pressure level over the 12 P frequency range for structural based actuators using accelerometers, microphones, and combinations thereof. Again, note that because speakers do not affect structural vibration, the uncontrolled vibration level shown in FIG. 9*b* is equivalent to the controlled vibration level when speakers and microphones are used. These two figures show that the structural vibration is not directly coupled to the noise in the 12 P frequency range. A structural based actuator can significantly increase structural vibration when controlling interior noise. In this frequency range, speakers should be used with microphone error sensors to reduce noise only. The structural vibration will remain unchanged.

Figure 10:
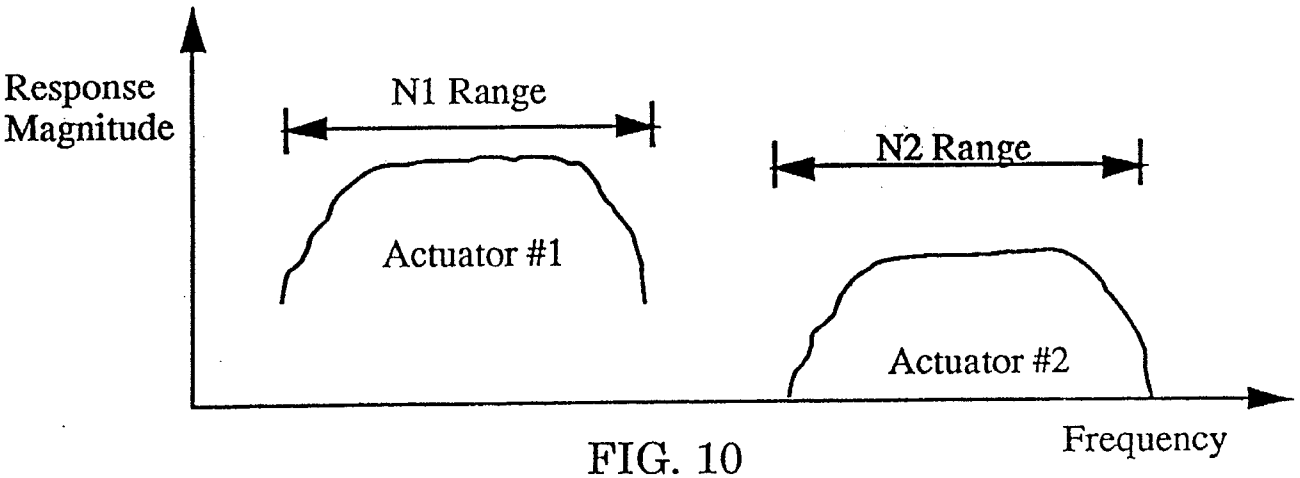
FIG. 10 is a plot of actuator response magnitude vs. frequency.

The use of frequency focused actuators requires the implementation of a modified control algorithm. Without loss of generality, the algorithm will be described with reference to two frequency ranges (an "N1" range and an "N2" range). The results discussed here are, however, directly generalizable to include more than two frequency ranges. For convenience, let actuator #1 be appropriately designed to handle the N1 frequency range and actuator #2 be appropriately designed to handle the N2 frequency range. Note that the response magnitudes of the different actuators do not have to be equal. This is described graphically in FIG. 10. It is noted that each algorithm has a software or math component and a hardware component. This discussion focuses on the differences in the hardware component.

Figure 11:
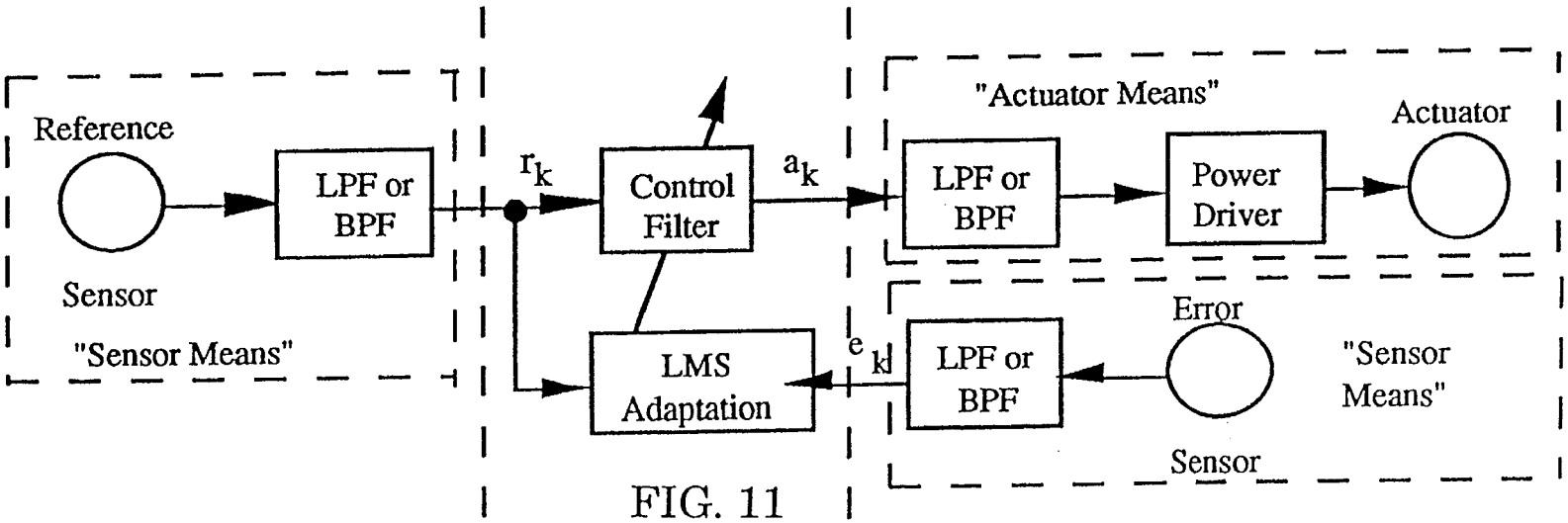
FIG. 11 is a block diagram for a SISO cancellation algorithm.

FIG. 11 is a block diagram of a single input-single output LMS cancellation algorithm embodying the principles of the invention. This algorithm will be implemented in multiple controllers with a first one tuned to a first frequency range and the second to another frequency range. Low pass filters (LPF) or, alternatively, band pass filters (BPF), 30 may be used. While filters 30 have been depicted as analog filters, they could be implemented digitally as well. For every actuator, there is a corresponding power driver and filter which together make up what can be called the actuator means. For every sensor there is a corresponding filter which together make up what is called the "sensor means". The term $r_k$ is defined to be the reference sensor samples, $a_k$ to be the actuator command samples, and $e_k$ to be the error sensor samples. A basic property of the LMS algorithm is that the control filter is made to converge to a filter which tends to reduce/eliminate any spectral components in $e_k$ which are directly correlated with the spectral components in $r_k$. Using frequency-focused actuators with the existing algorithms could potentially cause the control filters to respond to out-of-range spectral energy by continually increasing the output spectral components out of this range. This would inevitably lead to saturation at either the power driver, analog filter, or most likely the digital output device (e.g. D/A converter). In any event, overall performance would very likely be degraded without the practice of this invention.

Figure 12:
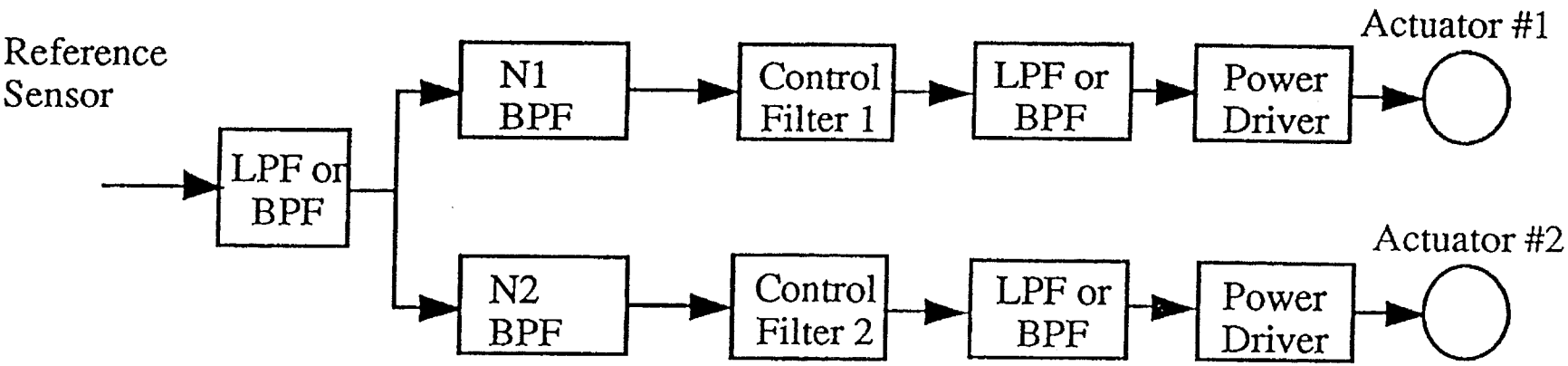
FIG. 12 is block diagram for a frequency focused controller.

For any frequency focused actuator, at least the corresponding reference sensor means must also be frequency focused, as well. In order to improve the convergence of the control filter, the error sensor means could also be frequency focused, although for most applications this is not necessary, and would unnecessarily increase the implementation cost. For example, microphone error sensors do not have to be frequency focused. They can be shared by both speakers and structural based actuators. Accelerometers, however, have to be frequency focused so that they are used only by structural based actuators and not speakers. For the two frequency focused actuators and a single reference sensor, this invention would take the form shown in FIG. 12 (without describing the LMS adaptation paths).

In some rare cases, we may have an application where individual reference sensors can be found which are already frequency focused. The simplest example is a filtered tachometer signal. In this case, the implementation would obviously follow from the preceding discussion. Another extension of this idea is to use sync or tach signals to locate the center frequency of an adjustable band pass filter.

According to the results of these tests, actuators and sensors should be chosen as follows:

(1) Use structural based actuators (i.e., inertial force actuators, active vibration absorbers or shaped PZT strips) to reduce both vibration and noise in frequency ranges where the interior noise is directly coupled to the structural vibration. Generally, this occurs at "low" frequencies, where there are few acoustic modes. Accelerometers and/or microphones could be used as the error sensors for this frequency range. Structural actuators should be used in this frequency range because interior noise and structural vibration can be reduced simultaneously. If speakers were used as actuators, then the interior noise would be reduced but the structural vibration would not. Structural based actuators should also outperform speakers in reducing interior noise in these frequency ranges.

(2) Use acoustic based actuators (i.e., speakers—woofers, mid-range, tweeters) to reduce noise only in frequency ranges where the interior noise is not directly coupled to the structural vibration. Generally, this occurs at "high" frequencies, where there are many acoustic modes. Microphones only should be used as the error sensors in this frequency range. Speakers should be used in this frequency range because they will greatly reduce interior noise without affecting structural vibration. Structural based actuators should not be used in these frequency bands because structural based actuators can increase structural vibration when reducing noise.

For an active control system that consists of both structural based actuators and speakers, microphones can be shared as the error sensors. Accelerometers, however, should be frequency focused so that they are only used in frequency ranges where structural based actuators are used. For maximum efficiency, the actuator resonances should be tuned to the low end of the desired frequency range.

Figure 13:
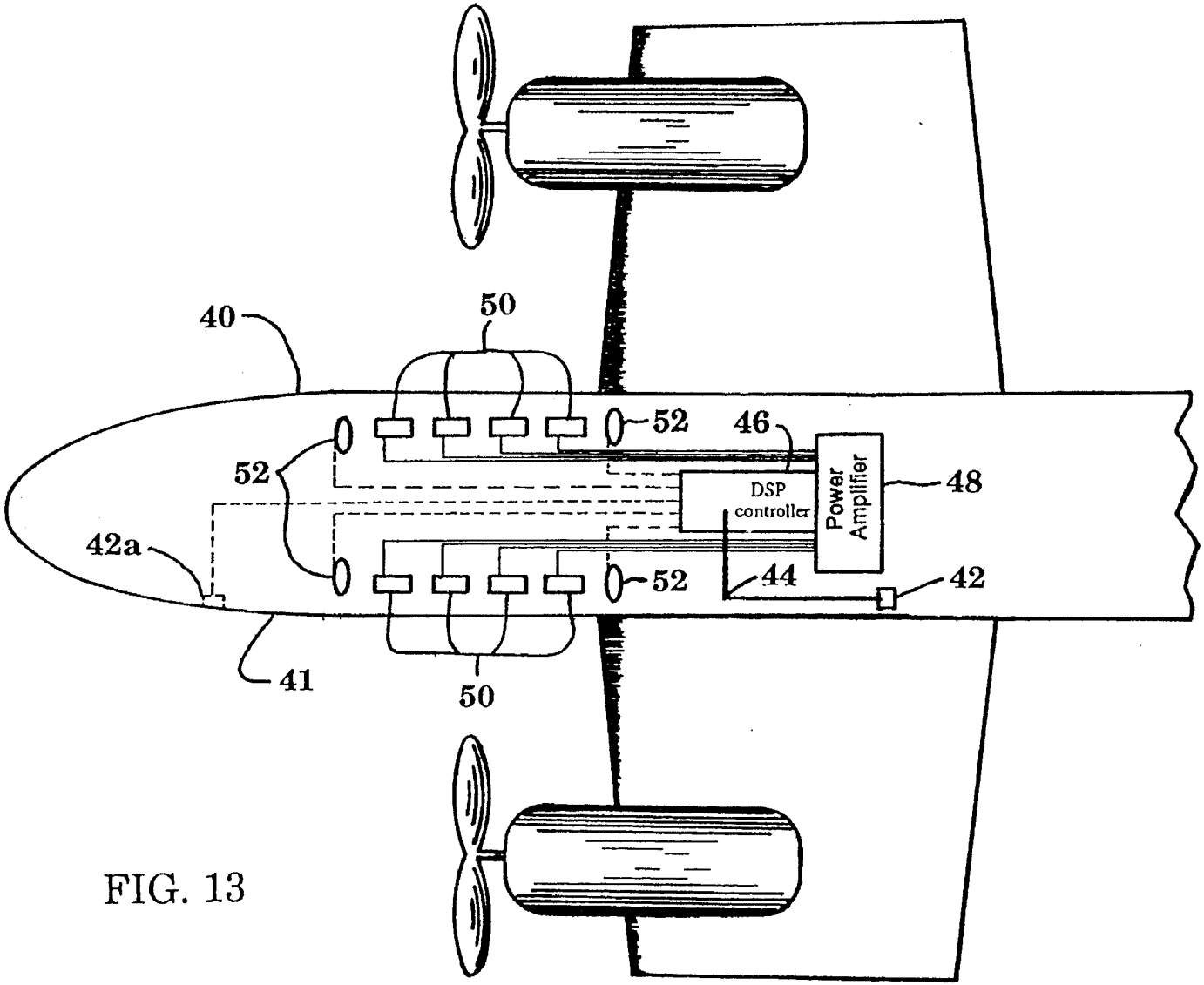
FIG. 13 is a schematic top view of a broadband control system in a turboprop application.
Figure 14:
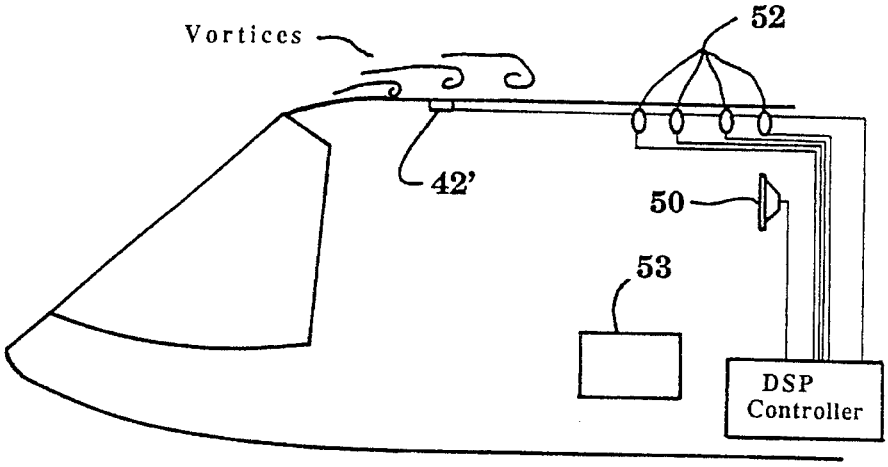
FIG. 14 is a schematic side view of a broadband control system in a slightly varied turboprop or turbofan application.
Figure 15:
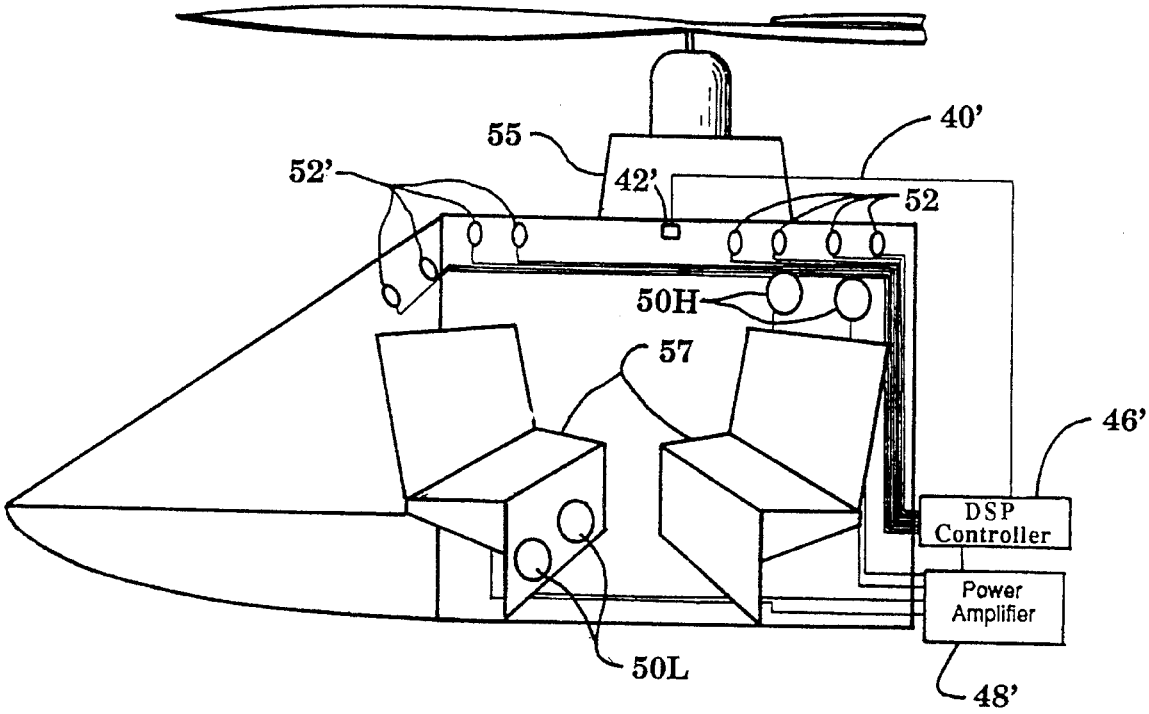
FIG. 15 is a schematic side view of a broadband control system in a rotary wing application.

Another feature of the present invention is the provision of an active noise and vibration system capable of broadband control. Several embodiments of the system 40 are depicted in FIGS. 13–15. FIG. 13 shows the broadband control system 40 employed in a turboprop aircraft 41. The broadband control system 40 includes reference sensor 42, which may be a microphone or accelerometer, to sense a the frequency spectrum and corresponding relative magnitude of a broadband disturbance signal. A critical aspect of this inventive feature is the positioning of this sensor 42 in a key location with respect to the broadband disturbance source. In the FIG. 13 embodiment, sensor 42 is shown as being positioned on a wing spar near a portion of the fuselage 41 which is subject to prop wash. A similar key location might be near a door or window opening where boundary layer and/or engine noise might be significantly increased. The broadband signal 44 is fed to a digital signal process (DSP) controller 46 which generates a series of command signals which are fed through power amplifier 48 to a bank of actuators 50. The actuators may be speakers or structural actuators including inertial shakers or PZT strips, or a combination of speakers and structural actuators in which case, cancellation can occur in accordance with the frequency focused technique described above. Error sensors 52 which are preferably microphones provide the error signals 53 which are fed back to the controller to tweak the command signals to improve the overall sound and vibration control.

Sensor 42*a* shown in an alternative dotted line position in FIG. 13 is positioned in the nose of the aircraft to pickup the broadband input signal of the external air noise such as created by the vortices in the boundary layer (see FIG. 14). Error sensors 52 are shown inside the cabin proximate the top of fuselage 41 although alternative positions are possible. For example, both the error sensors 52 and the speakers 50 may be mounted in the head rest of the seats 53 to provide a zone of silence in the vicinity of the passenger's ears.

Figure 16:
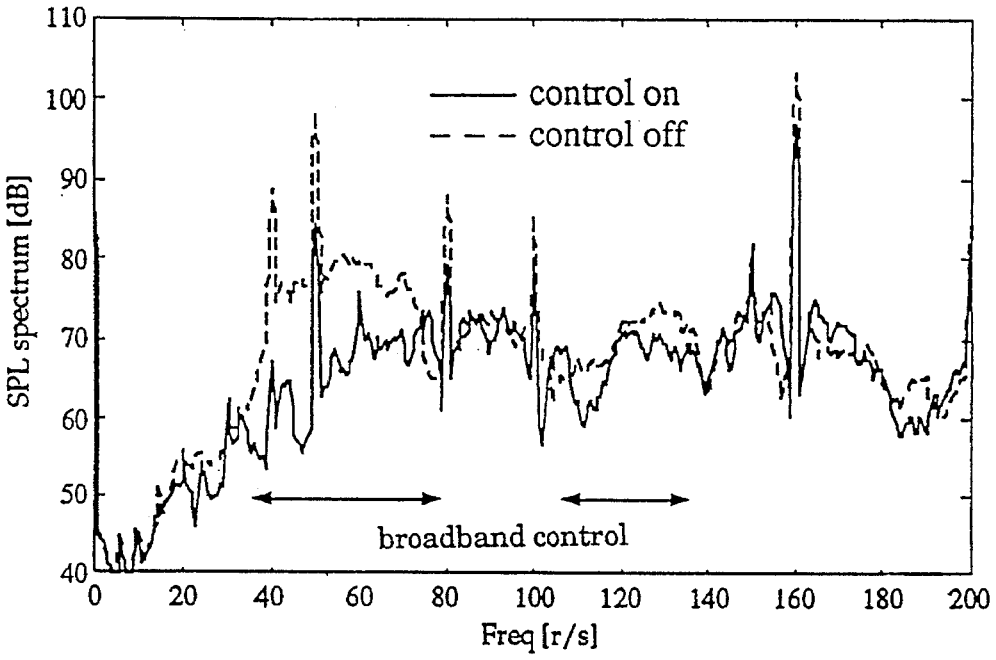
FIG. 16 is plot of sound pressure level vs. frequency for a broadband control system in a configuration similar to that shown in FIG. 15.

Another embodiment of broadband control system 40' is shown in a helicopter cabin 51 (FIG. 15). In this case, reference sensor 42' is positioned within the cabin adjacent the ceiling to pickup the vibrational energy transmitted by gear box 55. The command signals are fed by the controller 46' through amplifier 48' (which could be built into the controller) to actuators/speakers 50L and 50H, the low-frequency actuators 50L being positioned beneath the seats 57 and the high frequency speakers 50H are mounted on the headrests of seats 57. Error sensors 52' are shown distributed about the upper portion of the cabin walls to provide zones of control proximate the passengers' ears. A configuration much like that depicted in FIG. 15 was used to generate the data shown in FIG. 16. The residual spikes shown there could be further reduced by application of the frequency focusing principles discussed herein.

Figure 17:
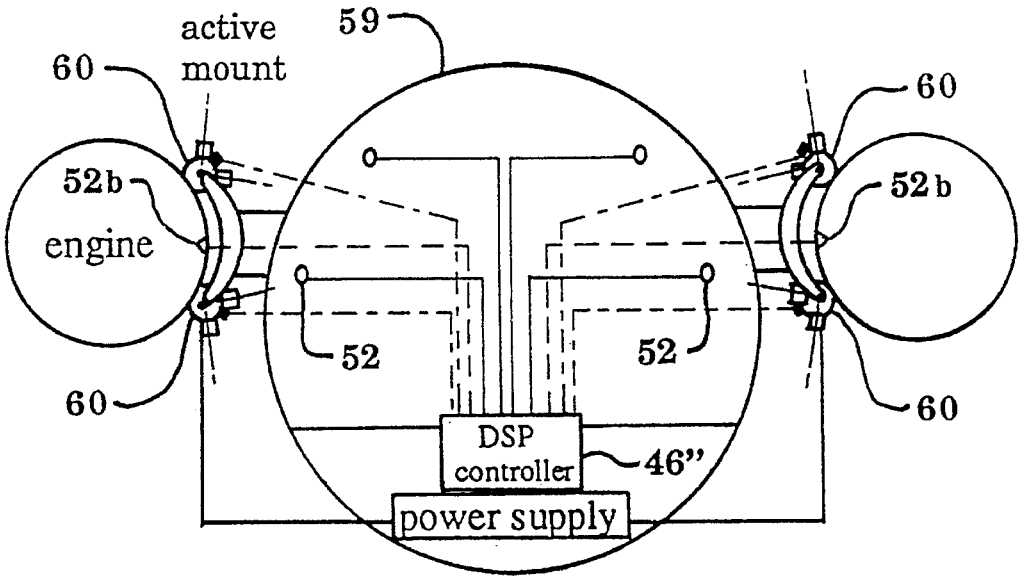
FIG. 17 is a schematic cross-sectional end view of a broadband control system employed in a turbofan aircraft which uses an active mount.

FIG. 17 depicts a broadband cancellation system 40" in conjunction with a turbofan aircraft 59. Engines 61 are mounted to the airframe using active mounts 60 in accordance with the more detailed description found in copending application Ser. No. 08/260,945 filed Jun. 16, 1994 entitled "Active Mounts for Aircraft Engines", which is hereby incorporated by reference. Inputs from microphones 52" and accelerometers 52*b* are fed to the controller 46" and are weighted and summed to produce a command signal which controls the actuators within active mounts 60. The combination of microphones 52" and accelerometers 52*b* enables the actuators within active mounts 60 to be manipulated to effectively control noise and vibration within compartment 41".

Various changes, alternatives and modifications will be apparent to one of ordinary skill in the art following a reading of the foregoing specification. It is intended that all such changes, alternatives and modifications as fall within the scope of the appended claims be considered part of the present invention.

We claim:

1. A system for canceling vibrational energy within a passenger compartment comprising:

a) reference signal detecting means for sensing a frequency spectrum and corresponding relative magnitude of a broadband signal emanating from at least one vibrational energy source to which said compartment is exposed, said broadband signal including sound energy, said detecting means being situated in a key location with respect to said energy source to intercept said broadband signal on its way to said compartment;

b) error sensor means for detecting a residual internal level of vibrational energy within said compartment, said error sensor means being positioned down stream of said reference sensor detecting means;

c) actuator means placed to provide a control signal of appropriate frequency and magnitude to cancel some portion of said broadband vibrational signal, said actuator means including:

i) first actuator means producing a control signal spanning a first frequency range, and ii) second actuator means producing a control signal spanning a second frequency range different from said first frequency range;

d) an adaptive controller including adaptive filters for generating broadband, time-domain command signals to activate said actuator means responsive to i) said detecting means, and ii) said error sensor means to generate control signals of appropriate frequency and magnitude to destructively interfere with said broadband vibrational signal.

2. The system for canceling noise and vibration of claim 1 wherein said actuator means comprises one or more speakers positioned within said compartment.

3. The system for canceling noise and vibration of claim 2 wherein said actuator means further comprises a series of actuators attached to portions of a structure forming said compartment which can be activated to vibrate said structure at a rate to cancel some portion of said broad-band signal.

4. An active vibration control system for controlling broadband vibrational energy within a passenger compartment of an aircraft or the like, comprising:

a) reference sensor means for monitoring a broadband vibrational energy input signal to be controlled, said reference sensor means being positioned within said passenger compartment proximate a point of entry for said broadband vibrational energy input signal, said vibrational energy input signal having various spectral frequencies, said sensor means producing a reference signal which corresponds to said broadband vibrational energy input signal;

b) first actuator means for producing a first control signal for destructively interfering with at least a first portion of said broadband vibrational energy input signal, said first control signal spanning a first range of frequencies;

c) second actuator means for producing a second control signal for destructively interfering with at least a second portion of said broadband vibrational energy input signal, said second control signal spanning a second range of frequencies at least some of which are different from said first range of frequencies;

d) an adaptive controller including adaptive filter means for processing said reference signal and producing at least two actuator command signals, one each to said first and second actuator means, which are of appropriate frequency and magnitude to activate a respective said actuator means;

e) error sensor means for sensing a residual signal resulting from combining said first and second control signals with said input signal, and f) circuitry means for feeding said residual signal back to said adaptive filter means to make adjustments in said actuator command signals.

5. The active vibrational control system of claim 4 wherein said aircraft comprises a turboprop.

6. The active vibrational control system of claim 5 wherein said reference sensor means is located on a wing spar adjacent a fusilage portion subject to prop wash of a turboprop power plant.

7. The active vibrational control system of claim 4 wherein said aircraft comprises a turbofan.

8. The active vibration control system of claim 7 wherein said reference sensor means comprise one or more spaced microphones within said enclosure.

9. The active vibration control system of claim 8 wherein said error sensor means comprise one or more spaced accelerometers attached to structural portions of said enclosure.

10. The active vibration control system of claim 9 wherein said enclosure comprises an aircraft cabin and said input signal includes external air noise created by vortices in a boundary layer flowing about an external portion of said aircraft's fusilage.

11. The active vibration control system of claim 4 wherein said circuitry means produces said actuator command signals in accordance with a weighted sum of said signals from said reference signal sensor means and said error sensor means.

12. An active vibration control system for controlling vibrational energy within a passenger compartment of an aircraft employing first and second active mounts for supporting respectively its first and second power plants comprising a) first reference sensor means for monitoring a vibrational energy input signal to be controlled including at least one accelerometer mounted on said first power plant, said sensor means producing a first reference signal which corresponds to at least a portion of said vibrational energy input signal;

b) second reference sensor means for monitoring a vibrational energy input signal to be controlled including at least one accelerometer mounted on said second power plant, said sensor means producing a second reference signal which corresponds to at least a portion of said vibrational energy input signal;

c) first actuator means contained with said active mount for producing a first control signal reducing at least a first portion of said vibrational energy input signal by countering motion resulting from said first power plant;

d) second actuator means contained within said active mount for producing a second control signal reducing at least a second portion of said vibrational energy input signal by countering motion resulting from said second power plant;

e) an adaptive controller including adaptive filter means for processing said first and second reference signals and producing at least two actuator command signals, one each to said first and second actuator means, which are of appropriate frequency and magnitude to activate a respective said actuator means;

f) error sensor means for sensing a residual signal resulting from combining said first and second control signals with said vibrational energy input signal, and g) circuitry means for feeding said residual signal back to said adaptive filter means to make adjustments in said actuator command signals.

13. The active vibration control system of claim 12 wherein said circuitry means produces said actuator command signals in accordance with a weighted sum of said signals from said reference signal sensor means and said error sensor means.

14. The active vibrational control system of claim 12 wherein said first and second actuator means each comprise a plurality of structural actuators positioned within said first and second active mounts.

* * * * *